US008877694B2

(12) United States Patent
Jones et al.

(10) Patent No.: US 8,877,694 B2
(45) Date of Patent: Nov. 4, 2014

(54) ASPHALTENE DISPERSANT CONTAINING LUBRICATING COMPOSITIONS

(75) Inventors: Joanne L. Jones, Nottingham (GB); William R. S. Barton, Belper (GB); Daniel J. Saccomando, Sheffield (GB); Stephen J. Cook, Belper (GB); Shaun P. Carney, Aston on Trent (GB); Alexandra Mayhew, Wirksworth (GB)

(73) Assignee: The Lubrizol Corporation, Wickliffe, OH (US)

( * ) Notice: Subject to any disclaimer, the term of this patent is extended or adjusted under 35 U.S.C. 154(b) by 0 days.

(21) Appl. No.: 13/979,728

(22) PCT Filed: Feb. 8, 2012

(86) PCT No.: PCT/US2012/024255

§ 371 (c)(1),
(2), (4) Date: Jul. 15, 2013

(87) PCT Pub. No.: WO2012/109311

PCT Pub. Date: Aug. 16, 2012

(65) Prior Publication Data

US 2013/0303415 A1 Nov. 14, 2013

Related U.S. Application Data

(60) Provisional application No. 61/440,990, filed on Feb. 9, 2011.

(51) Int. Cl.

| | |
|---|---|
| ***C07D 207/26*** | (2006.01) |
| ***C10M 169/04*** | (2006.01) |
| ***C10M 133/56*** | (2006.01) |
| ***C07C 51/15*** | (2006.01) |
| ***C10M 115/08*** | (2006.01) |
| ***C10M 163/00*** | (2006.01) |
| ***C10M 133/44*** | (2006.01) |
| ***C10M 141/06*** | (2006.01) |

(52) U.S. Cl.

CPC ..... *C10M 133/44* (2013.01); *C10M 163/00* (2013.01); *C10M 2215/223* (2013.01); *C10M 2219/088* (2013.01); *C10M 2223/045* (2013.01); *C10M 2203/1006* (2013.01); *C10N 2240/102* (2013.01); *C10M 2207/028* (2013.01); *C10M 2215/221* (2013.01); *C10N 2230/10* (2013.01); *C10M 2215/086* (2013.01); *C10M 2219/089* (2013.01); *C10M 141/06* (2013.01); *C10M 2219/087* (2013.01); *C10M 2207/027* (2013.01); *C10N 2230/04* (2013.01); *C10M 2215/224* (2013.01); *C10M 2207/262* (2013.01); *C10M 2215/08* (2013.01)

USPC ..... 508/268; 508/287; 508/291; 508/518; 508/551

(58) Field of Classification Search

USPC ..... 508/255, 283, 291, 551, 518

See application file for complete search history.

(56) References Cited

U.S. PATENT DOCUMENTS

| | | | | |
|---|---|---|---|---|
| 3,018,291 | A | 1/1962 | Anderson et al. | |
| 3,948,800 | A * | 4/1976 | Meinhardt | 516/31 |
| 5,334,329 | A * | 8/1994 | Vinci et al. | 508/194 |
| 2002/0119896 | A1 * | 8/2002 | Yagishita et al. | 508/291 |
| 2004/0248747 | A1 * | 12/2004 | Mayhew et al. | 508/527 |
| 2005/0209110 | A1 | 9/2005 | Roski et al. | |
| 2007/0124990 | A1 | 6/2007 | Chheda | |

FOREIGN PATENT DOCUMENTS

| | | | |
|---|---|---|---|
| WO | 03/018728 | A1 | 3/2003 |
| WO | 2005/112575 | A2 | 12/2005 |
| WO | 2010/115594 | A1 | 10/2010 |

OTHER PUBLICATIONS

Rounds, Fred G., "Effects of Additives on the Friction of Steel on Steel. I. Surface Topography and Film Compositions Studies", Chemical Abstracts Service, XP-002673789, vol. 7, No. 1, Jan. 1, 1964, pp. 11-21.

Goldstein, David M., "Preparation of Amino-pyrimidinylbenzotriazoles As Kinase Modulators", Chemical Abstracts Service, XP-002673811, Mar. 13, 2008, pp. 1-3.

* cited by examiner

*Primary Examiner* — Vishal Vasisth

(74) *Attorney, Agent, or Firm* — Christopher D. Hilker

(57) ABSTRACT

The present invention relates to a lubricating composition, particularly marine diesel engine lubricating compositions, comprising: (a) an oil of lubricating viscosity; (b) an asphaltene dispersant comprising an amide group, which may also contain a succinimide group, and which may optionally be used in combination with additional asphaltene dispersants that contain a cyclic headgroup that contains a nitrogen atoms where the additional asphaltene dispersants may also include a succinimide group; and (c) a detergent derived from an alkyl phenol. The invention further provides methods of using such compositions in the operation of engine, particularly marine diesel engines.

14 Claims, No Drawings

ASPHALTENE DISPERSANT CONTAINING LUBRICATING COMPOSITIONS

CROSS REFERENCE TO RELATED APPLICATION

This application claims priority from PCT Application Serial No. PCT/US2012/024255 filed on Feb. 8, 2012, which claims the benefit of U.S. Provisional Application No. 61/440,990 filed on Feb. 9, 2011.

BACKGROUND OF THE INVENTION

The present invention relates to lubricating oil compositions and in particular to lubricating oil compositions suitable for medium or low speed diesel engines, such as marine diesel engines, including the four-stroke trunk-piston engine.

Lubricating oils for such engines are known and typically contain a range of additives which will perform a variety of functions. However contamination of these lubricating oil compositions with unburned residual fuel oil is a problem recognized in the industry. This leads to severe engine cleanliness problems in service which is sometimes referred to as "black paint" of asphaltene deposits. The problem is particularly widespread in marine diesel engines, such as 4-stroke trunk-piston engines where dirty cam boxes and crankcases are encountered, and 2-stroke cross-head engines which usually use two separate lubricating oils, one for the crankcase and one for the cylinder. It is in the crankcase of these 2-stroke engines where there is potential for these heavy deposits to occur.

There is a need for lubricating compositions that address the asphaltene and/or "black paint" deposit issues, such as those seen in marine diesel engines without reducing the lubricating compositions performance in other areas, including overall detergency.

SUMMARY OF THE INVENTION

The present invention provides a lubricating composition, such as a marine diesel engine lubricating composition, comprising: (a) an oil of lubricating viscosity; (b) an asphaltene dispersant comprising an amide group; and (c) a detergent derived from an alkyl phenol.

The asphaltene dispersants of the invention include an amide group and may also contain a succinimide group. In some embodiments the dispersants are used in combination with additional asphaltene dispersants that contain a nitrogen-containing cyclic headgroup. These additional asphaltene dispersants may also include a succinimide group. These additional asphaltene dispersants may be derived from the amide-group containing asphaltene dispersants, where the dispersant reacts with itself such that the amide group reacts with another nitrogen atom present in the compound closing a ring that creates the cyclic headgroup. While not wishing to be bound by theory it is believed that the performance benefits of the invention are provided in some embodiments by the asphaltene dispersants that include an amide group and which may also contain a succinimide group. However, in other embodiments the performance benefits of the invention are provided by the combination of the asphaltene dispersants that include an amide group and the additional asphaltene dispersants that contain a nitrogen-containing cyclic headgroup.

In some embodiments the compositions of the present invention: contain a minimum amount, such as least 1 weight percent, of the alkyl phenol detergent; further comprise (d) a salicylate detergent, wherein some maximum amount, such as 50 percent or less, of the total base number (TBN) of the overall composition is delivered from the salicylate detergent; or combinations thereof.

The invention further provides methods of using such compositions in the operation of engine, particularly marine diesel engines.

DETAILED DESCRIPTION OF THE INVENTION

Various features and embodiments of the invention will be described below by way of non-limiting illustration.

The Asphaltene Dispersant

The compositions of the present invention contain an asphaltene dispersant comprising an amide group. The dispersant may optionally further include at least one additional heteroatom.

The asphaltene dispersant contains at least one amide group and may also include a succinimide group. In such embodiments where the compounds contains an amide group and a succinimide group it may also contain at least one additional nitrogen atom, and in some cases two or three additional nitrogen atoms. In some embodiments the dispersant is present in a mixture of additives, where these other additives are additional asphaltene dispersants that contain at least one amidine headgroup, urea headgroup, guanidine headgroup, or combinations thereof, and may also include a succinimide group. In some embodiments, the headgroup of these additional asphaltene dispersant contains a five-member ring, a six-member ring, or combinations thereof.

In other embodiments the compositions of the invention include the asphaltene dispersant comprising an amide group and are substantially or essentially free of the asphaltene dispersants that include a nitrogen-containing cyclic headgroup other than a succinimide headgroup. These headgroups are described above and again do not include succinimide groups, which may be present in all asphaltene dispersants described herein. In some embodiments, when considering the total amount of asphaltene dispersants present in the composition, the asphaltene dispersants that include a nitrogen-containing cyclic headgroup represent less than 50%, 25%, 10% or even 5% of the asphaltene dispersants. In other embodiments the nitrogen-containing cyclic headgroup asphaltene dispersants represent less than 1% of the asphaltene dispersants present, where these percent values may be applied on a weight basis. In still other embodiments the compositions of the invention are free of asphaltene dispersants that include a nitrogen-containing cyclic headgroup.

More specifically, asphaltene dispersants that contain an amide group suitable for use in the compositions and methods of the present invention include compounds represented by the following formula:

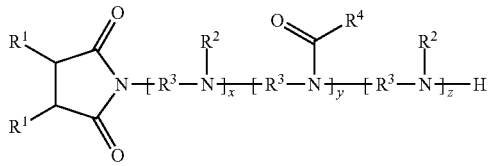

(I)

wherein for formula (I), each $R^1$ is independently a hydrogen or a hydrocarbyl group containing 1 to 250 carbon atoms, so long as at least one R1 is a hydrocarbyl group; each $R^2$ is independently a hydrogen or a hydrocarbyl group containing 1 to 10 carbon atoms; each $R^3$ is independently a hydrocarbylene group containing from 1 to 10 carbon atoms; each $R^4$ is independently a hydrocarbyl group containing from 1 to 50 carbon atoms; x is an integer from 0 to 6; y is an integer from 1 to 4; and z is an integer from 0 to 6.

In some embodiments one $R^1$ is hydrogen, with the other $R^1$ is derived from polyisobutylene, and in some embodiments from polyisobutylene having a number average molecular weight of 500 to 3500, 500 to 2000, or even from 1000 to 1500. Each $R^2$ may be a hydrogen or a hydrocarbyl group containing 1 to 4, 1 to 2, or even 1 carbon atoms while in other embodiments each $R^2$ is hydrogen. Each $R^3$ may be a hydrocarbylene group containing from 1 to 4, 1 to 2, or even 2 carbon atoms and in some of these embodiments is a linear hydrocarbylene group. Each $R^4$ may be a hydrocarbyl group containing from 1 to 30, 1 to 24, 8 to 28, 10 to 28, or even 12 to 24 carbon atoms, and in some embodiments may be a linear hydrocarbyl group. X may be an integer from 0 to 4, 0 to 3, 1 to 3, 2 to 3, or even 0, 1, 2, or 3 in various embodiments, while y may be an integer from 1 to 4, 1 to 3, 1 to 2 or even 1 in various embodiments, while z may be an integer from 0 to 4, 0 to 3, 1 to 3, 2 to 3, or even 0, 1, 2, or 3 in various embodiments. In some of these embodiments the sum of x and z may be from 1 to 8, 2 to 6 or even 3.

In still other embodiments x is 2, y is 1, z is 1, one $R^1$ is hydrogen while the other $R^1$ is derived from polyisobutylene, each R2 is hydrogen, each R3 is a hydrocarbylene groups containing 2 to 4 or even 2 carbon atoms, and each R4 is a hydrocarbyl group containing from 12 to 24 carbon atoms.

The compositions of the invention may further comprise additional asphaltene dispersants, where these additional dispersants contain at least one amidine headgroup, urea headgroup, guanidine headgroup, or combinations thereof, and may also include a succinimide group. In some embodiments, the headgroup of these additional asphaltene dispersant contains a five-member ring, a six-member ring, or combinations thereof. In these embodiments the compositions and methods of the invention may further include compounds represented by the following formula:

(II)

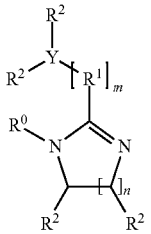

(III)

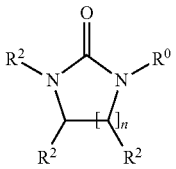

wherein, for each of the formulas (II) and (III), each $R^0$ is independently a hydrogen or a hydrocarbyl group containing 1 to 250 carbon atoms each $R^1$ is independently a hydrocarbyl group comprising 1 to 10 carbon atoms; each $R^2$ is independently hydrogen, a hydroxy alkyl group, or a hydrocarbyl group comprising 1 to 50 carbon atoms; Y is a carbon atom or a nitrogen atom; n is 1 or 2; and m is 0 or 1.

In some embodiments, each $R^0$ is a hydrocarbyl group containing a sufficient number of carbon atoms to render the compound oil-soluble. In other embodiments, $R^0$ is a hydrocarbyl containing 8 or more carbon atoms, or 8 to 250 carbon atoms. In some embodiments each $R^1$ is a hydrocarbyl group containing 1 to 6 carbon atoms, 1 to 2 carbon atoms, or 1 carbon atom. In some embodiments each $R^2$ is a hydrogen or a hydrocarbyl group containing 1 to 4 carbon atoms. The hydrocarbyl groups present in the formulas herein may contain hetero atoms, and in some embodiments hydrocarbyl groups such as $R^0$ may be groups such as $—CH_2(CH_2)_mOH$ or $—CH_2(CH_2)_mNH_2$ where m is 0 to 249, or 7 to 249, or at least 7.

In some embodiments, the additional asphaltene dispersants useful in the invention include compounds represented by any of the following formulas:

(IV)

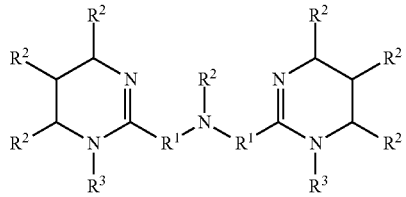

(V)

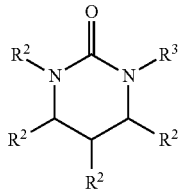

(VI)

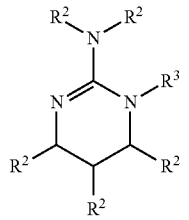

(VII)

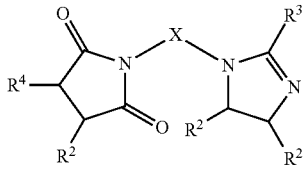

wherein, for each of the formulas (IV), (V), (VI) and (VII) above, each $R^1$ is independently a hydrocarbylene group comprising 1 to 10 carbon atoms; each $R^2$ is independently hydrogen or a hydrocarbyl group comprising 1 to 50 carbon atoms; each $R^3$ is independently a hydrocarbyl group containing 1 to 50 carbon atoms; $R^4$ is a hydrocarbyl group containing 1 to 200 carbon atoms; and X is a hydrocarbylene group derived from an amine or a polyamine comprising 1 to 20 carbon atoms and 1 to 5 nitrogen atoms;

In some embodiments, each $R^1$ is a hydrocarbylene group containing 1 to 6 carbon atoms, 1 to 2 carbon atoms, or 1 carbon atom. In other embodiments at least one $R^1$ group contains 1 carbon atom. In some embodiments each $R^2$ is a hydrogen or a hydrocarbyl group containing 1 to 4 carbon atoms. In some embodiments each $R^3$ is a hydrocarbyl group containing 8 or more carbon atoms, 8 to 30 carbon atoms, 12 to 24 carbon atoms, or 12 to 22 carbon atoms. In other embodiments at least one $R^3$ group contains a sufficient number of carbon atoms to render the compound oil-soluble. In some embodiments R4 is a hydrocarbyl group containing 20 to 200 carbon atoms or 50 to 150 carbon atoms. In some embodiments X is a hydrocarbylene group derived from an amine or a polyamine comprising 2 to 10 carbon atoms, 4 to 8 carbon atoms, or 6 carbon atoms in addition to 1 to 5 nitrogen atoms, 1 to 3 nitrogen atoms, or 2 nitrogen atoms.

In some embodiments at least one $R^2$ group present in any of the compounds described above is a monounsaturated hydrocarbyl group. In some embodiments, the $R^4$ group, of formula (VII), is derived from polyisobutylene. In some embodiments X is derived from a polyalkylene polyamine. In some embodiments Z is derived from a polyalkylene polyamine.

As noted above, in some embodiments these additional asphaltene dispersants are present in combination with the amide group containing asphaltene dispersant. In some embodiments the performance benefits of the present invention are provided primarily by the amide group containing asphaltene dispersant while in other embodiments the performance benefits of the present invention are provided by the combination of the amide group containing asphaltene dispersant with these additional asphaltene dispersants. In some of these embodiments the amount of additional asphaltene dispersants present is limited, and may be limited to less than have of the total amount of asphaltene dispersants present in the composition, or even to a maximum of 2%, 1% or even 0.5% by weight of the overall composition, or even still further embodiments in amounts such that the weight ratio of the amount of amide group containing asphaltene dispersant to the amount of additional asphaltene dispersants is no more than 1:1, 2:1, 5:1 or even 10:1. By 10:1, the ratio indicates that there are at least 10 parts of amide group containing asphaltene dispersant to every 1 part of additional asphaltene dispersants.

With regards to all of the asphaltene dispersants discussed above, the various hydrocarbyl groups described for the formulas above may contain hetero atoms as well as cyclic groups, including cyclic groups formed by the linking of two or more hydrocarbyl groups present in the compound, forming a ring. In some embodiments the hydrocarbyl groups of the formulas above contain an alkyl amine and/or a hydroxy group.

In addition to the compounds described above, the asphaltene dispersants may also include compounds containing five member ring ureas, imidazolines, imidazoles, tetrazoles, tetrazolines, tetrazolones, lactams, sultams, thioureas, triazoles, triazolines, pyridones, pyrimidones, or combinations thereof.

Still other examples of compounds that may be present in the asphaltene dispersants of the present invention include dihydropyrimidines, tetrahydropyrimidines, pyrazole, imidazoline, dihydropyrimidinone, triazine, dihydrotriazine, tetrahydrotriazine, oxadiazoles, thiadiazole, dihydrooxadiazole, dihydrothiadiazole, or combinations thereof.

The asphaltene dispersant compounds described above may be used alone or in combination with one another.

The Alkyl Phenol Detergent

The compositions of the present invention include a detergent derived from an alkyl phenol.

Suitable alkyl phenol detergents include phenate detergents, such as phenate sulfides, including calcium phenate sulfides. In some embodiments the calcium phenate sulfides are neutral detergents, and in other embodiments the calcium phenate sulfides are overbased detergents. The phenate may be a sulphur-containing phenate, a methylene-bridged phenate, or mixtures thereof. In one embodiment the phenate is sulphur-containing phenate.

In some embodiments the alkyl phenol detergent is present in the compositions of the present invention at 1 percent by weight or more in the overall composition. In other embodiments the alkyl phenol detergent is present at least 2, 3, 4, 6, 8 or 10 percent by weight in the overall composition.

In some embodiments, the alkyl phenol detergent delivers at least 50 percent of the TBN provided by detergents in the composition, or even with regards to the TBN of the overall composition, including any TBN provided by dispersants and other additives which may be present. In other embodiments the alkyl phenol detergent delivers at least 60 percent, 70 percent, 75 percent, 90 percent or 95 percent of the TBN from detergents, or the TBN of the overall composition. In still other embodiments the compositions of the present invention are substantially free of other detergents such that alkyl phenol detergents deliver more than 99 percent, more than 99.5 percent, or even 100 percent of the TBN provided by detergents. In still further embodiments, the alkyl phenol detergent may provide at least 50, 60, 75, 90, 99 or even 100 percent of the TBN of all of the detergents present in the overall composition.

The phenate detergent may be a neutral or overbased material. Overbased materials, otherwise referred to as overbased or superbased salts, are generally single phase, homogeneous Newtonian systems characterised by an amount of excess metal that which would be necessary for neutralisation according to the stoichiometry of the metal and the particular acidic organic compound reacted with the metal. The amount of excess metal is commonly expressed in terms of substrate to metal ratio. The term "substrate to metal ratio" is the ratio of the total equivalents of the metal to the equivalents of the substrate. A more detailed description of the term metal ratio is provided in "Chemistry and Technology of Lubricants", Second Edition, Edited by R. M. Mortier and S. T. Orszulik, pages 85 and 86, 1997.

The overbased alkali or alkaline earth metal phenate detergent may have a metal ratio of 0.8 or 1.0 to 10 or 3 to 9, or 4 to 8, or 5 to 7. The phenate detergents may be overbased with calcium hydroxide.

In different embodiments the alkali or alkaline earth metal phenate detergent may have a total base number (TBN) of 30 or 50 to 400; or 200 to 350; or 220 to 300, and in another embodiment 255. In other embodiments the phenate detergent has a TBN in the range of 30, 40 or 50 to 220, 205, or 190, and in another embodiment 150. In still other embodiments the phenate detergent has a TBN of 300 or more, 350 or more, or 400 or more, or from 300 or 350 to 400, and in another embodiment 395.

More detailed descriptions of suitable alkali or alkaline earth metal phenate detergents are found in U.S. Pat. No. 6,551,965 and European Patent publications EP 1903093 A, EP 0601721 A, EP 0271262B2 and EP 0273588 B2.

Suitable phenate detergents may be formed by reacting an alkylphenol, an alkaline earth metal base and sulfur, typically carried out in the presence of a promoter solvent to form a sulfurized metal phenate. The alkylphenols useful in the present invention are of the formula $R(C_6H_4)OH$ where R is a straight chain or branched chain alkyl group having from 8 to 40 carbon atoms and preferably from 10 to 30 carbons, and the moiety $(C_6H_4)$ is a benzene ring. Examples of suitable alkyl groups include octyl, decyl, dodecyl, tetradecyl, and hexadecyl groups The alkaline earth metal base can be a base of calcium, barium, magnesium and strontium. Preferred are calcium and magnesium. The most commonly used bases are the oxides and hydroxides of the above metals such as calcium oxide, calcium hydroxide, barium oxide, barium hydroxide, magnesium oxide, and the like. Calcium hydroxide, commonly called hydrated lime, is most commonly used.

The promoter solvent, also sometimes referred to as a mutual solvent, can be any stable organic liquid which has appreciable solubility for the alkaline earth metal base, the alkylphenol, and the sulfurized metal phenate intermediate. Suitable solvents include glycols and glycol monoethers such as ethylene glycol, 1,4-butane diol, and derivatives of ethylene glycol, such as monomethyl ether, monoethyl ether, etc. In one embodiment the solvent is one or more vicinal glycols and in another embodiment the solvent includes ethylene glycol.

The sulfur used in the reaction is elemental sulfur and may be used in the form of molten sulfur.

In some embodiments the phenate detergent is prepared in the presence of a co-surfactant. Suitable co-surfactants include low base alkylbenzene sulfonates, hydrocarbyl substituted acylating agents such as polyisobutenyl succinic anhydrides (PIBSA), and succinimide dispersants such as polyisobutenyl succinimides. Suitable sulfonates include sulfonic acid salts from sulfonic acids having a molecular weight preferably of more than 400 obtained by sulfonating alkylbenzenes derived from olefins or polymers of C2-C4 olefins of chain length C15-C80 and alkaline earth metals such as calcium, barium, magnesium etc. Suitable co-surfactants include and/or may be derived from PIBSA, which may itself be derived from 300 to 5000, or 500 to 3000, or 800 to 1600 number average molecular weight polyisobutylene.

As noted above, these phenate detergents may be overbased by reacting them with carbon dioxide gas in the presence of additional alkaline earth metal base, typically in the presence of a promoter solvent.

In one embodiment, the phenate sulfide detergents of the composition can be represented by the formula:

(VIII)

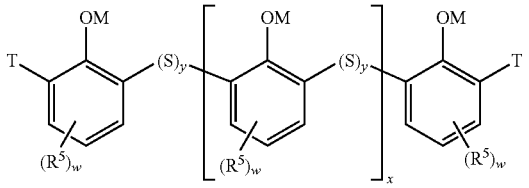

wherein the number of sulphur atoms y can be in the range from 1 to 8, preferably 1 to 6 and even more preferably 1 to 4; $R^5$ can be hydrogen or hydrocarbyl groups; T is hydrogen or an $(S)_y$ linkage terminating in hydrogen, an ion or a non-phenolic hydrocarbyl group; w can be an integer from 0 to 4; and M is hydrogen, a valence of a metal ion, an ammonium ion and mixtures thereof.

When M is an equivalent of a metal ion, the metal can be monovalent, divalent, trivalent or mixtures of such metals. When monovalent, the metal M can be an alkali metal, such as lithium, sodium, potassium or combinations thereof. When divalent, the metal M can be an alkaline earth metal, such as magnesium, calcium, barium or mixtures of such metals. When trivalent, the metal M can be aluminum. In one embodiment the metal is an alkaline earth metal and in another embodiment the metal is calcium.

The monomeric units of structure (VIII) combine in such a way with itself x number of times to form oligomers of hydrocarbyl phenol. Oligomers are described as dimers, trimers, tetramers, pentamers and hexamers when x is equal to 0, 1, 2, 3, and 4. Typically the number of oligomers represented by x can be in the range from 0 to 10, preferably 1 to 9, more preferably 1 to 8, even more even more preferably 2 to 6 and even more preferably 2 to 5. Typically an oligomer is present in significant quantities if concentrations are above 0.1 wt %, preferably above 1 wt % and even more preferably above 2 wt %. Typically an oligomer is present in trace amounts if concentrations are less than 0.1 wt %, for example, oligomers with 11 or more repeat units may be present. Generally in at least 50 percent of the molecules, x is 2 or higher. In some embodiments the overall sulfur-containing phenate detergent contains less than 20 percent by weight dimeric structures.

In Structure (VIII), each $R^5$ can be hydrogen or a hydrocarbyl group containing 4 to 80, 6 to 45, 8 to 30 or even 9 to 20 or 14 carbon atoms. The number of $R^5$ substituents (w) other than hydrogen on each aromatic ring can be in the range from 0 to 4, 1 to 3 or even 1 to 2 or 1. Where two or more hydrocarbyl groups are present they may be the same or different and the minimum total number of carbon atoms present in the hydrocarbyl substituents on all the rings, to ensure oil solubility, can be 8 or 9. The preferred components include 4-alkylated phenols containing alkyl groups with the number of carbon atoms between 9 and 14, for example 9, 10, 11, 12, 13, 14 and mixtures thereof. The 4-alkylated phenols typically contain sulphur at position 2. The phenate detergent represented by structure (VIII) above may also be overbased using an alkaline earth metal base, such as calcium hydroxide.

In some embodiments the phenate detergent used in the present invention is an overbased sulfurized alkaline earth metal hydrocarbyl phenate, which may optionally be modified by the incorporation of at least one carboxylic acid having the formula: R—CH($R^1$)—COOH where R is a $C_{10}$ to $C_{24}$ straight chain alkyl group and $R^1$ is hydrogen, or an anhydride or ester thereof. Such overbased phenates may be prepared by reacting: (a) a non-overbased sulfurized alkaline earth metal hydrocarbyl phenate as described above, (b) an alkaline earth metal base which may be added as a whole or in increments, (c) either a polyhydric alcohol having from 2 to 4 carbon atoms, a di- or tri-($C_2$ to $C_4$) glycol, an alkylene glycol alkyl ether or a polyalkylene glycol alkyl ether, (d) a lubricating oil present as a diluent, (e) carbon dioxide added subsequent to each addition of component (b), and optionally (f) at least one carboxylic acid as defined above.

Component (b) may be any of the earth metal based described above and in some embodiments is calcium hydroxide.

Component (c) may suitably be either a dihydric alcohol, for example ethylene glycol or propylene glycol, or a trihydric alcohol, for example glycerol. The di- or tri-($C_2$ to $C_4$) glycol may suitably be either diethylene glycol or triethylene glycol. The alkylene glycol alkyl ether or polyalkylene glycol alkyl ether may suitably be of the formula: $R(OR^1)_xOR^2$ where R is a $C_1$ to $C_6$ alkyl group, $R^1$ is an alkylene group, $R^2$ is hydrogen or $C_1$ to $C_6$ alkyl and x is an integer in the range from 1 to 6. Suitable examples include the monomethyl or dimethyl ethers of ethyleneglycol, diethylene glycol, triethylene glycol or tetraethylene glycol. A particularly suitable solvent is methyl digol. Mixtures of glycols and glycol ethers may also be employed. In some embodiments the glycol or glycol ether is used in combination with an inorganic halide. In one embodiment, component (c) is either ethylene glycol or methyl digol, the latter in combination with ammonium chloride and acetic acid.

In some embodiments, component (f), the carboxylic acid used to modify the phenate has an R group that is an unbranched alkyl group, which may contain from 10 to 24 or 18 to 24 carbon atoms. Examples of suitable saturated carboxylic acids include capric acid, lauric acid, myristic acid, palmitic acid, stearic acid, arachidic acid, behenic acid and lignoceric acid. Mixtures of acids may also be employed. Instead of, or in addition to, the carboxylic acid, there may be used the acid anhydride or the ester derivatives of the acid, preferably the acid anhydride. In one embodiment the acid used is stearic acid.

In some embodiments, sulphur additional to that already present by way of component (a), may be added to the reaction mixture. The reaction described above may be carried out in the presence of a catalyst. Suitable catalysts include hydrogen chloride, calcium chloride, ammonium chloride, aluminum chloride and zinc chloride The Salicylate Detergent The compositions of the present invention may further include a salicylate detergent. Typical salicylate detergents are metal overbased salicylates having a sufficiently long hydrocarbon substituent to promote oil solubility. Hydrocarbyl-substituted salicylic acids can be prepared by the reaction of the corresponding phenol by reaction of an alkali metal salt thereof with carbon dioxide. The hydrocarbon substituent can be as described for the carboxylate or phenate detergents.

More particularly, hydrocarbon-substituted salicylic acids may be represented by the formula (IX)

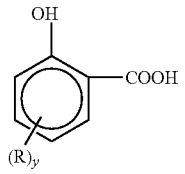

wherein each R is an aliphatic hydrocarbyl group, and y is independently 1, 2, 3 or 4, with the proviso that R and y are such that the total number of carbon atoms provided by the R groups is at least 7 carbon atoms. In one embodiment, y is 1 or 2, and in one embodiment y is 1. The total number of carbon atoms provided by the R groups may be 7 to 50, and in one embodiment 12 to 50, and in one embodiment 12 to 40, and in one embodiment 12 to 30, and in one embodiment 16 to 24, and in one embodiment 16 to 18, and in one embodiment 20 to 24. In one embodiment, y is 1 and R is an alkyl group containing 16 to 18 carbon atoms. Overbased salicylic acid detergents and their preparation are described in greater detail in U.S. Pat. No. 3,372,116.

In one embodiment, the metal salt is Infineum M7101 which is a product supplied by Infineum USA LP identified as a calcium salicylate dispersed in oil having a TBN of 168, a calcium content of 6.0% by weight, an a diluent oil concentration of 40% by weight.

In some embodiments, the salicylate detergent delivers no more than 50 percent of the TBN of the overall composition. In other embodiments the salicylate detergent delivers no more than 40 percent, 30 percent, 25 percent, 10 percent or 5 percent of the TBN of the overall composition. In still other embodiments the compositions of the present invention are substantially free of salicylate detergents such that salicylate detergents deliver no more than 0.5 percent of the TBN of the overall composition, or even 0 percent of the of the TBN of the overall composition. In some embodiments the salicylate is present in the compositions of the present invention at such amounts that no more than 30 percent, or 25 percent, of the TBN of the overall composition is provided by the salicylate detergent.

The Oil of Lubricating Viscosity

The invention further includes an oil of lubricating viscosity. Suitable oils include natural and synthetic oils, oil derived from hydrocracking, hydrogenation, hydrofinishing, unrefined, refined and re-refined oils and mixtures thereof.

Unrefined oils are those obtained directly from a natural or synthetic source generally without (or with little) further purification treatment.

Refined oils are similar to the unrefined oils except they have been further treated in one or more purification steps to improve one or more properties. Purification techniques are known in the art and include solvent extraction, secondary distillation, acid or base extraction, filtration, percolation and the like.

Re-refined oils are also known as reclaimed or reprocessed oils, and are obtained by processes similar to those used to obtain refined oils and often are additionally processed by techniques directed to removal of spent additives and oil breakdown products.

Natural oils useful in making the inventive lubricants include animal oils, vegetable oils (e.g., castor oil, lard oil), mineral lubricating oils such as liquid petroleum oils and solvent-treated or acid-treated mineral lubricating oils of the paraffinic, naphthenic or mixed paraffinic-naphthenic types and oils derived from coal or shale or mixtures thereof.

Synthetic lubricating oils are useful and include hydrocarbon oils such as polymerised and interpolymerised olefins (e.g., polybutylenes, polypropylenes, propyleneisobutylene copolymers); poly(1-hexenes), poly(1-octenes), poly(1-decenes), and mixtures thereof alkyl-benzenes (e.g. dodecylbenzenes, tetradecylbenzenes, dinonylbenzenes, di-(2-ethylhexyl)benzenes); polyphenyls (e.g., biphenyls, terphenyls, alkylated polyphenyls); alkylated diphenyl ethers and alkylated diphenyl sulphides and the derivatives, analogs and homologs thereof or mixtures thereof.

Other synthetic lubricating oils include but are not limited to liquid esters of phosphorus-containing acids (e.g., tricresyl phosphate, trioctyl phosphate, and the diethyl ester of decane phosphonic acid), and polymeric tetrahydrofurans. Synthetic oils may be produced by Fischer-Tropsch reactions and typically may be hydroisomerised Fischer-Tropsch hydrocarbons or waxes.

Oils of lubricating viscosity can also be defined as specified in the American Petroleum Institute (API) Base Oil Interchangeability Guidelines. The five base oil groups are as follows: Group I (sulphur content>0.03 wt %, and/or <90 wt % saturates, viscosity index 80-120); Group II (sulphur content≤0.03 wt %, and ≥90 wt % saturates, viscosity index 80-120); Group III (sulphur content≤0.03 wt %, and ≥90 wt % saturates, viscosity index≥120); Group IV (all polyalphaolefins (PAOs)); and Group V (all others not included in Groups I, II, III, or IV). The oil of lubricating viscosity comprises an API Group I, Group II, Group III, Group IV, Group V oil and mixtures thereof. Preferably the oil of lubricating viscosity an API Group I, Group II, Group III, Group IV oil and mixtures thereof. More preferably the oil of lubricating viscosity an API Group I, Group II, Group III oil and mixtures thereof.

The Lubricating Compositions

As described above, the compositions of the present invention comprise: (a) an oil of lubricating viscosity; (b) an asphaltene dispersant comprising an amide group, and which may in some embodiments also include a succinimide group; and (c) a detergent derived from an alkyl phenol.

In some embodiments the compositions of the present invention have a TBN of at least 25. In such embodiments, the amount of TBN delivered from the alkyl phenol detergent can be any of the minimum percentages described above. In such embodiments, the amount of TBN delivered from the salicylate detergent can be any of the maximum percentages described above.

In some embodiments the lubricating compositions of the present invention are marine diesel engine lubricants.

Component (a), the lubricating oil, may be present in the lubricating compositions of the present invention at 55 to 99.9, 60 to 98, 65 to 96, or 67 to 94 percent by weight. Component (b), the asphaltene dispersant, may be present in the lubricating compositions of the present invention at 0.1 to 6.0, 0.2 to 5.0, or 0.5 to 4.0, or even 1.0 to 4.0 or 3.0 percent by weight. Component (c), the alkyl phenol derived detergent, may be present in the lubricating compositions of the present invention at 0.5 to 30, 1 to 25, 2 to 22, or 5 to 20 percent by weight. When present, component (d), the salicylate detergent, may be present in the lubricating compositions of the present invention at greater than 0 to 10, 0.1 to 8, or 0.5 to 5 percent by weight. The ranges provided herein for the asphaltene dispersant may be applied to the asphaltene dispersant comprising an amide group, or in other embodiments may be applied to the combination of asphaltene dispersants comprising an amide group and any additional asphaltene dispersants present in the composition. In still other embodiments the range for the asphaltene dispersant provided above may be applied independently to the asphaltene dispersants comprising an amide group and any additional asphaltene dispersants present in the composition The compositions of the present invention may contain additional performance additives that are different from components (a)-(d). When present these additional additives may be present in the lubricating compositions of the present invention (either separately or combined) at 0 to 10, 0.1 to 7, 0.2 to 5, or even 1 to 5 percent by weight of the overall lubricating composition.

Additional performance additives may also be present in the lubricating compositions described herein, especially those additives that have been used in marine diesel cylinder lubricants. Among known lubricant additives are metal salts of a phosphorus acid, including metal compounds represented by the formula:

(X)

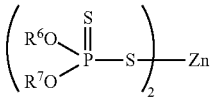

where the $R^6$ and $R^7$ groups are independently hydrocarbyl groups that are typically free from acetylenic and usually also from ethylenic unsaturation. They are typically alkyl, cycloalkyl, aralkyl or alkaryl group and have 3 to 20, 3 to 16 or 3 to 13 carbon atoms. The alcohol which reacts to provide the $R^6$ and $R^7$ groups can be a mixture of a secondary alcohol and a primary alcohol, for instance, a mixture of 2-ethylhexanol and 2-propanol or, alternatively, a mixture of secondary alcohols such as 2-propanol and 4-methyl-2-pentanol. Such materials are often referred to as zinc dialkyldithiophosphates or simply zinc dithiophosphates. They are well known and readily available to those skilled in the art of lubricant formulation. The amount of the metal salt of a phosphorus acid in a completely formulated lubricant, if present, may be 0.1 to 4, 0.5 to 2, or 0.75 to 1.25 percent by weight.

Additional performance additives which may be present in the compositions of the present invention include: metal deactivators, dispersants, antioxidants, antiwear agents, corrosion inhibitors, antiscuffing agents, extreme pressure agents, foam inhibitors, demulsifiers, friction modifiers, viscosity modifiers, pour point depressants and mixtures thereof. Typically, fully-formulated lubricating oil will contain one or more of these performance additives.

Metal deactivators may be present including derivatives of benzotriazole, 1,2,4-triazoles, benzimidazoles, 2-alkyldithiobenzimidazoles, 2-alkyldithiobenzothiazoles, 2-(N,N-dialkyldithiocarbamoyl)benzothiazoles, 2,5-bis(alkyldithio)-1,3,4-thiadiazoles, 2,5-bis(N,N-dialkyldithiocarbamoyl)-1,3,4-thiadiazoles, and 2-alkyldithio-5-mercapto thiadiazoles. In one embodiment the metal deactivator is 5-methylbenzotriazole (tolyltriazole).

Additional dispersants, different from the asphaltene dispersants described above, may be present including N-substituted long chain alkenyl succinimides such as polyisobutylene succinimide derived from polyisobutylene with a number average molecular weight in the range 350 to 5000 or 500 to 3000. In one embodiment the invention further comprises at least one dispersant derived from polyisobutylene succinimide derived from polyisobutylene with number average molecular weight in the range 350 to 5000 or 500 to 3000. Another class of ashless dispersants is the Mannich bases. Mannich dispersants are the reaction products of alkyl phenols with aldehydes and amines where the alkyl group typically contains at least 30 carbon atoms.

Antioxidants may be present, including diphenylamines, hindered phenols, molybdenum dithiocarbamates, sulphurised olefins and mixtures thereof. Phenolic antioxidants include butyl substituted phenols containing 2 or 3 t-alkyl groups, especially t-butyl groups. The para position of the phenol may also be occupied by a hydrocarbyl group, including an ester-containing group or a group bridging two aromatic rings. Antioxidants also include: aromatic amines, such as an alkylated diphenylamine such as nonylated diphenylamine, including mixtures of di-nonylated amine and mono-nonylated amine; sulfurized olefins, such as mono-, or disulfides or mixtures thereof; and molybdenum compounds. These materials can serve other functions as well, such as antiwear agents.

Corrosion inhibitors may be present, including amine salts of carboxylic acids such as octylamine octanoate (octylamine salt of octanoic acid), condensation products of dodecenyl succinic acid or anhydride and a fatty acid such as oleic acid with a polyamine, and half esters of alkenyl succinic acids with alkenyl containing 8 to 24 carbon atoms reacted with polyglycols.

Antiscuffing agents may be present including organic sulfides and polysulfides, such as benzyldisulfide, bis-(chlorobenzyl) disulphide, dibutyl tetrasulfide, di-tertiary butyl polysulfide, sulfurized sperm oil, sulfurized methyl ester of oleic acid, sulfurized alkylphenol, sulfurized dipentene, sulfurized terpene, sulfurized Diels-Alder adducts, alkyl sulfenyl N'N-dialkyl dithiocarbamates, the reaction product of polyamines with polybasic acid esters, chlorobutyl esters of 2,3-dibromopropoxyisobutyric acid, acetoxymethyl esters of dialkyl dithiocarbamic acid and acyloxyalkyl ethers of xanthogenic acids and mixtures thereof.

Extreme Pressure (EP) agents may be present, including oil soluble sulphur- and chlorosulphur-containing EP agents, chlorinated hydrocarbon EP agents and phosphorus EP agents.

Foam inhibitors may be present including organic silicones such as polyacetates, dimethyl silicone, polysiloxanes, polyacrylates or mixtures thereof. Examples of foam inhibitors include silicones, poly ethyl acrylate, copolymers of ethyl acrylate and 2-ethylhexylacrylate, and copolymers of ethyl acrylate, 2-ethylhexylacrylate, and poly vinyl acetate.

Demulsifiers may be present including derivatives of propylene oxide, ethylene oxide, polyoxyalkylene alcohols, alkyl amines, amino alcohols, diamines or polyamines reacted sequentially with ethylene oxide or substituted ethylene oxides or mixtures thereof. Examples of demulsifiers include trialkyl phosphates, polyethylene glycols, polyethylene oxides, polypropylene oxides, (ethylene oxide-propylene oxide) polymers and mixtures thereof.

Pour point depressants may be present including: esters of maleic anhydride-styrene copolymers; polymethacrylates; polyacrylates; polyacrylamides; condensation products of haloparaffin waxes and aromatic compounds; vinyl carboxylate polymers; and terpolymers of dialkyl fumarates, vinyl esters of fatty acids, ethylene-vinyl acetate copolymers, alkyl phenol formaldehyde condensation resins, alkyl vinyl ethers and mixtures thereof.

Friction modifiers may be present including fatty amines and esters including glycerol esters such as glycerol monooleate, borated glycerol esters, fatty phosphites, fatty acid amides, fatty epoxides, borated fatty epoxides, alkoxylated fatty amines, borated alkoxylated fatty amines, metal salts of fatty acids, sulfurized olefins, fatty imidazolines, condensation products of carboxylic acids and polyalkylene-polyamines, and amine salts of alkylphosphoric acids.

Viscosity modifiers may be present including hydrogenated styrene-butadiene rubbers, ethylene-propylene copolymers, polyisobutenes, hydrogenated styrene-isoprene polymers, hydrogenated radical isoprene polymers, polymethacrylate acid esters, polyacrylate acid esters, polyalkyl styrenes, hydrogenated alkenyl aryl conjugated diene copolymers, polyolefins, polyalkylmethacrylates, esters of maleic anhydride-styrene copolymers and mixtures thereof.

Industrial Application

The lubricating composition of the present invention is useful for an internal combustion engine, for example stationary combustion engine, such as a power station combustion engine; a diesel fuelled engine, a gasoline fuelled engine, a natural gas fuelled engine or a mixed gasoline/alcohol fuelled engine.

In one embodiment the internal combustion engine is a 4-stroke and in another embodiment a 2-stroke engine. In one embodiment the diesel fuelled engine is a marine diesel engine.

The present invention also includes methods of operating engines, such as marine diesel engines and power station combustion engine, by lubricating them with the compositions of the present invention. These methods include the steps of operating an engine and supplying the compositions described above to the engine.

In some embodiments, the compositions of the present invention are used as a system oil and/or crankcase oil in a marine diesel engine. In some embodiments, the compositions of the present invention are not marine diesel engine cylinder oils and are not used in marine diesel engines as cylinder oils.

Suitable marine diesel engines for use with the compositions and methods of the present are not overly limited. Suitable engines include 4-stroke trunk piston engines as well as 2-stroke cross-head engines that utilize a system oil. The use of the lubricating oil composition can impart one or more of improved cleanliness decreased cylinder wear, reduced deposits and reduced "black paint" build-up.

The invention also includes a process to prepare the lubricating compositions of the present invention, comprising mixing: (a) an oil of lubricating viscosity; (b) an asphaltene dispersant comprising an amide group, and which may in some embodiments also include a succinimide group; and (c) a detergent derived from an alkyl phenol. The mixing conditions are typically 15° C. to 130° C., 20° C. to 120° C. or even 25° C. to 110° C.; and for a period of time in the range 30 seconds to 48 hours, 2 minutes to 24 hours, or even 5 minutes to 16 hours; and at pressures in the range 86.4 kPa to 266 kPa (650 mm Hg to 2000 mm Hg), 91.8 kPa to 200 kPa (690 mm Hg to 1500 mm Hg), or even 95.1 kPa to 133 kPa (715 mm Hg to 1000 mm Hg).

The process optionally includes mixing other performance additives as described above into the composition as well as the additional asphaltene dispersant described above. The optional performance additives can be added sequentially, separately or as a concentrate.

If the present invention is in the form of a concentrate (which can be combined with additional oil to form, in whole or in part, a finished lubricant), the ratio of each of the above-mentioned dispersant, as well as other components, to diluent oil is typically in the range of 80:20 to 10:90 by weight.

Preparation of Asphaltene Dispersants

The examples below provide specific embodiments of the asphaltene dispersants of the present invention as well as methods of preparing the same. These methods of preparing such additives may be generalized and are contemplated as part of the present invention.

For instance, the additives of the present invention may derived from the reaction of a compound containing at least one —COOR group and a compound containing at least two nitrogen atoms where the nitrogen atoms are separated by two or three carbon atoms and where R can be a hydrogen or a hydrocarbyl group, which may include one or more hetero atoms.

In some embodiments the compound is derived from an acid, such as a carboxylic acid, reacted with a compound containing at least two nitrogen atoms where the nitrogen atoms are separated by two or three carbon atoms. In some embodiments the carboxylic acid used to prepared the substantially linear compound has the structure: R'—O—C(O)—R" where each R' and R" is independently a hydrogen or a hydrocarbyl group, In some embodiments R" contains from 1 to 250, 5 to 200, 10 to 50 or 16 to 20 carbon atoms. R" may be derived from oleic acid or tallowic acid. In some embodiments the nitrogen containing compound reacted with the acid has a structure: (R')(R')N—R"—N(R')—R"—Y where Y is —N(R')(R') or —OR' and each R' is independently a hydrogen or a hydrocarbyl group, and each R" is independently a hydrocarbyl group. Examples of suitable compounds include diethylenetriamine, aminoethyl ethanolamine, N,N-dimethylaminopropyl aminopropylamine, a polyisobutylene succinimide dispersant and combinations thereof. In some embodiments the carboxylic acid used in the preparation of the dispersants is a monocarboxylic acid. In other embodiments the dispersant is prepared from one or more dimer fatty acids, or a mixture of monocarboxylic acids and dimer acids. Suitable dimer acids include fatty dimer acids, that is dimer acids containing more than 8 carbon atoms. In other embodiments suitable dimer acids are smaller and contain from 1 to 4, 6, 8 or even 10 carbon atoms. These ranges may also be applied to the monocarboxylic acids used in the invention.

In some embodiments the compound is derived from a compound containing at least two nitrogen atoms where the nitrogen atoms are separated by two or three carbon atoms reacted with an oxygen containing compound. The nitrogen containing compound may be a polyamine, such as N1-cocopropane-1,3-diamine, 1-(3-aminopropyl)-imidazole, N-tallowpropyldiamine, N-dodecylpropylamine, or combinations thereof. The oxygen containing compound may generally have the structure: R'—O—C(O)—$(CH_2)_n$[C(O)]$_m$—O—R" where R' is hydrogen or a hydrocarbyl group, n is 0, 1 or 2, m is 0 or 1, and R" is a hydrogen or a hydrocarbyl group. Suitable examples include glycolic acid, diethyl carbonate, and even polyisobutylene succinic anhydride, guanidine carbonate, and combinations thereof.

As noted above the invention provides a process of preparing an asphaltene dispersant that includes the steps of (1) reacting (i) a substantially linear succinimide dispersant that contains at least two nitrogen atoms where the nitrogen atoms are separated by two or three carbon atoms with (ii) a carboxylic acid, resulting in an asphaltene dispersant comprising an amide group. The invention also provides for a process where the described reaction may also produce asphaltene dispersants where the compound reacts with itself to form a ring structure containing the two said nitrogen atoms, such that the resulting dispersant comprises an asphaltene dispersant comprising an amide group and an asphaltene dispersant comprising a cyclic headgroup wherein said headgroup contains two nitrogen atoms.

The reactions described above may be carried out at elevated temperatures, optionally in the presence of a solvent such as toluene. Products are often vacuum stripped and/or filtered to remove unused reactants. The resulting compounds may, under certain circumstances, then further react with themselves, also at elevated temperatures, resulting in a ring structure containing compound, thus providing the additional asphaltene dispersants described above As used herein, the terms "hydrocarbyl" and "hydrocarbylene" as used with respect to groups and or substituents are used in their ordinary sense, which is well-known to those skilled in the art. Specifically, these terms all refer to a group having a carbon atom directly attached to the remainder of the molecule and having predominantly hydrocarbon character. Examples of hydrocarbyl and hydrocarbylene groups include: hydrocarbon substituents and/or connecting groups, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring); substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy); hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the present invention in its intended use, may not be susceptible of easy description. Nevertheless, all such modifications and reaction products are included within the scope of the present invention; the present invention encompasses the composition prepared by admixing the components described above.

EXAMPLES

The invention will be further illustrated by the following examples, which sets forth particularly advantageous embodiments. While the examples are provided to illustrate the present invention, they are not intended to limit it.

Example 1

An asphaltene dispersant containing a mixture of dispersants containing a cyclic headgroup and dispersants containing an amide group is prepared by charging oleic acid (50 grams), toluene (50 grams) and N1-(3-dimethylamino-propyl)-propane-1,3-diamine (29.63 grams) to a 250 ml round bottom flask (Flask A) for reaction, equipped with overhead stirrer, heating mantle, thermocouple, Dean-Stark trap water cooled condenser and nitrogen inlet. The materials are mixed in the flask at 250 rpm and warmed to 100° C. The mixture is held with mixing for 1 hour and then warmed to 110° C. and held with mixing overnight. The mixture is then warmed to 120° C. and held with mixing for 1 hour, warmed to 130° C. and held with mixing for 1 hour, warmed to 135° C. and held with mixing overnight, warmed to 140° C. and held with mixing for 1 hour, warmed to 150° C. and held with mixing overnight. The reaction mixture is then cooled and allowed to stand over the weekend. The reaction mixture is then warmed to 160° C. and held with mixing for 1 hour, warmed to 170° C. and held with mixing for 1 hour, warmed to 185° C. and held with mixing for 30 hours. The reaction is monitored by IR checking for a large amide peak with amidine peak shoulder at 1646 $cm^1$. The collected product (71.81 grams) is a pale yellow liquid The collected product (61.4 grams) is then charged to a 250 ml 3-neck round bottom flask (Flask B), equipped with Dean-Stark trap and water cooled condenser, magnetic stirrer, heating mantle and thermocouple, and nitrogen inlet. The material is warmed to 200° C. with mixing at 100 rpm and held for 0.5 hours to allow the system to equilibrate. The material is then warmed to 210° C. and held with mixing for 1.5 hours. The material is allowed to cool to room temperature overnight and then is warmed to 220° C. and held with mixing for 4 hours. The material is then cooled to 100° C. and collected. The process is monitored by IR checking for an increase in peak intensity at 1615 $cm^{-1}$ (for the amidine) and a decrease in peak intensity at 1646 $cm^{-1}$ (for the amide). The resulting material (61.4 grams) is a viscous clear orange oil with a total base number (TBN) of 216 mg KOH/g. The resulting material contains a 2-alkyl-tetrahydro-pyrimidine, specifically 2-oleyl-1-(3-dimethylaminopropyl)-1,4,5,6-tetrahydro-pyrimidine.

Example 2

An asphaltene dispersant containing a mixture of dispersants containing a cyclic headgroup and dispersants containing an amide group is prepared by charging oleic acid [2-(2-hydroxy-ethylamino)-ethyl]-amide (83.29 grams), to a 250 ml flask, equipped as Flask B described above. The material is warmed to 200° C. with stirring at 100 rpm for 0.5 hours. The material is then warmed to 220° C. and held with mixing for 2 hours. The material is allowed to cool to room temperature overnight. The material is then warmed to 220° C. and held with mixing for 4 hours. The material is then cooled to 100° C. and collected. The process is monitored by IR checking for an increase in peak intensity at 1605 $cm^{-1}$ (for the amidine) and a decrease in peak intensity at 1650 $cm^{-1}$ (for the amide). The resulting material (73.6 grams) is a viscous clear orange oil with a TBN of 149 mg KOH/g. The resulting material contains a 2-alkylimidazoline, specifically 2-oleyl-1-(2-hydroxyethyl)-imidazoline.

Example 3

An asphaltene dispersant containing a mixture of dispersants containing a cyclic headgroup and dispersants containing an amide group is prepared according to the procedure of Example 1, except that N1-tallow-propane-1,3-diamine (50 grams), toluene (50 grams) and glycolic acid (11.75 grams) are charged to the reaction flask. The first part of the process, in the Flask A system, results in 50.22 grams of a waxy solid. The second part of the process, in the Flask B system, results in 34.32 grams of a 1-alkyl-tetrahydropyrimidine, specifically (1-tallow-1,4,5,6-tetrahydropyrimidin-2-yl)methanol.

Example 4

An asphaltene dispersant containing a succinimide group is prepared by charging polyisobutylene succinic anhydride (PIBSA), derived from polyisobutylene having a number average molecular weight (Mn) of 2300, (502.5 grams) to a 1 litre reaction flask, equipped similarly to Flask A described above. The material is heated to 150° C. under nitrogen with mixing at 350 rpm. 1-(3-aminopropyl)-imidazole (22.8 grams) is then added to the flask dropwise over 0.5 hours. After the feed is complete, the reaction mixture is held at 150° C. for 3.5 hours. The reaction is monitored by IR checking for a large imide peak at 1702 $cm^{-1}$. The resulting material (515.5 grams) is a dark brown material and contains a 1-alkylimidazole, specifically (1-polyisobutenesuccinimidylpropyl)imidazole.

Example 5

An asphaltene dispersant which does not contain an amide group is prepared by charging N1-coco-propane-1,3-diamine (55.36 grams) and diethyl carbonate (29.45 grams) to a 250 ml reaction flask, equipped as Flask A described above. The mixture is heated to 100° C. under nitrogen with mixing at 300 rpm. The mixture is held at temperature with mixing for 16 hours and is then warmed to 135° C. and held with mixing for 5 hours, then warmed to 150° C. and held with mixing for 3 hours. The mixture is then cooled to room temperature, and then warmed to 120° C. and held with mixing for 16 hours, then warmed to 180° C. and held with mixing for 2 hours, then warmed to 190° C. and held with mixing for 1 hour. The reaction is monitored by IR. The resulting material (51.09 grams) is a white, soft waxy solid and contains a 1-alkyl-tetrahydro-pyrimidin-2-one, specifically 1-coco-tetrahydro-pyrimidin-2-one.

Example 6

An asphaltene dispersant is prepared by charging Duomeen™ O (1126 grams), iminodiacetic acid (228.9 grams), and xylene (1500 ml) to a 5-liter round bottom flask equipped with a mechanical overheard stirrer, thermocouple and heating mantle, sub-surface nitrogen sparge line, and Dean-Stark trap with condenser. A polydimethylsiloxane is added (6 drops) and the mixture is heated, with stirring, to 145° C. over 4.5 hours. The mixture is then held at 150° C. for 2 hours, then held at 155° C. for 2.5 hours, then held at 160° C. for 1.5 hours, then held at 170° C. for 1.5 hours, then held at 180° C. for 1.5 hours, then held at 200° C. for 6.5 hours, then held at 220° C. for 16 hours, and then held at 230° C. for 8 hours, distilling off xylene as the temperature increases. The flask is allowed to cool and is held at various points overnight, resuming the next day at the same point. The resulting material (1175 grams) is cooled and collected.

Example 7

An asphaltene dispersant is prepared by charging Duomeen™ T (2504.6 grams) and ethylene glycol (437.6 grams) to a 5-liter round bottom flask equipped as described in Example 5 above. The material is heated to 105° C. with stirring. Ethylene carbonate (620.67) is added over 1 hour with the mixture exotherming to 108° C. The mixture is then held at 105° C., with mixing, for 1 hour, then held at 130° C. for 5 hours, then held at 180° C. for 6.5 hours. The mixture is then vacuum distilled at 180° C. and about −0.9 bar for 3 hours in order to remove the ethylene glycol solvent. The flask is allowed to cool and is held at various points overnight, resuming the next day at the same point. The resulting material (2654.5 grams) is cooled and collected.

Example 8

An asphaltene dispersant containing a mixture of dispersants containing a cyclic headgroup and dispersants containing an amide group is prepared by charging diethylenetriamine (164.65 grams) and toluene (350 ml) to a 1 liter reaction flask, equipped similarly to Flask A described above. The mixture is heated to 100° C. with mixing. The mixture is then heated to 135° C. and oleic acid (151.11 grams) is added dropwise over 5 hours. The mixture is then heated to 135° C. and held, with mixing, for 17 hours. Excess toluene and diethylenetriamine is vacuum stripped from the flask at 135° C. and about −0.9 bar over 3 hours. The flask is allowed to cool and is held at various points overnight, resuming the next day at the same point. The resulting material (169.9 grams) is cooled and collected.

Example 9

An asphaltene dispersant containing a mixture of dispersants containing a cyclic headgroup and dispersants containing an amide group is prepared by charging oleic acid (300 grams) and toluene (100 grams) to a 1 liter reaction flask, equipped similarly to Flask A described above. The mixture is heated to 125° C. with stirring and aminoethyl ethanolamine (110.6 grams) is then added over 1 hour. The reaction mixture is then heated to 135° C. and held, with mixing, for 2 hours, then heated to 170° C. over 1 hour, collecting and removing distillate from the system, then warmed to 210° C. and held, with stirring, for 2 hours, then heated to 215° C. and held, with stirring, for 3 hours. The reaction mixture is then vacuum distilled at 215° C. and 100 mbar for 0.5 hours. The resulting material (363.45 grams) is cooled and collected.

Example 10

An asphaltene dispersant containing a mixture of dispersants containing a cyclic headgroup and dispersants containing an amide group is prepared by charging oleic acid (300 grams) and toluene (100 grams) to a 1 liter reaction flask, equipped similarly to Flask A described above. The mixture is heated to 100° C. with stirring and N,N-dimethylaminopropyl aminopropylamine (100 grams) is then added over 1 hour. The reaction mixture is then held for 0.5 hours, and then heated to 130° C. and held, with mixing, for 0.5 hours, then heated to 150° C. and held for 1 hour, then warmed to 175° C. and held, with mixing, overnight, then warmed to 200° C. and held for 1 hour, then warmed to 215° C. and held for 1 hour, then warmed to 220° C. and held for 3 hours. The reaction mixture is then vacuum distilled at temperature for 5 hours. The resulting material (386.11 grams) is cooled and collected.

Example 11

An asphaltene dispersant containing a mixture of dispersants containing a cyclic headgroup and dispersants containing an amide group is prepared by charging a polyisobutenyl succinimide dispersant, derived from 1000 Mn PIBSA and tetraethylene pentamine, (475.5 grams) to a 1 liter reaction flask, equipped similarly to Flask A described above. The material is heated to 175° C. with stirring and held for 1 hour. The material is cooled to 100° C. and tall oil fatty acid (43.9 grams) is added over 6 minutes. The mixture is then heated, with stirring, to 230° C. over 0.5 hours and then held for 22 hours. The resulting material (503.4 grams) is cooled and collected.

Example 12

An asphaltene dispersant containing a mixture of dispersants containing a cyclic headgroup and dispersants containing an amide group is prepared by charging Duomeen™ T (300 grams) and glycolic acid (70.42 grams) to a 1 liter reaction flask, equipped similarly to Flask A described above. The material is heated to 140° C. with stirring and held for 24 hours. The material is then heated to 220° C. and held for 8 hours, and then cooled and held at room temperature overnight. The material (310.68 grams) is then collected and is a dark brown waxy solid at room temperature.

Example 13

An asphaltene dispersant is prepared by charging Duomeen™ T (300 grams) to a 1 liter reaction flask, equipped similarly to Flask A described above. The material is heated to 110° C. with stirring and guanidine carbonate (166.8 grams) is added over 1 hour. The reaction is then heated to 155° C. over 2 hours and then held for 1 hour, then heated to 185° C. and held, with stirring, overnight. The reaction mixture is then cooled to 120° C. and filtered using FAX-5 filter aid. The resulting material (165.4 grams) is collected and is an ivory, hard waxy solid.

Example 14

An asphaltene dispersant containing a mixture of dispersants containing a cyclic headgroup and dispersants containing an amide group where all the dispersants also contain a succinimide group is prepared by charging a polyisobutenyl succinimide dispersant, derived from 1000 Mn PIBSA and tetraethylene pentamine, (450.2 grams) to a 1 liter reaction flask, equipped similarly to Flask A described above. The material is heated to 150° C. with stirring and held for 1 hour. Tall oil fatty acid (41.3 grams) is added over 15 minutes. The material is heated, with stirring, to 175° C. and held at this temperature for 3 hours, using these somewhat more mild reaction conditions to maximize the amount of amide containing dispersants and minimize the amount of dispersants containing cyclic headgroups. The resulting material (472.0 grams) is cooled and collected.

Comparative Example 15

A succinimide dispersant is prepared by charging a polyisobutenyl succinic anhydride (number average molecular weight of 1000) (745.0 g) and diluent oil (149.8 g) into a 1.5 litre reaction flask, equipped similarly to flask A describe above. The material is heated to 110° C. Tetraethylene pentamine (115.6 g) is added over 1.5 hours. The material is heated, with stirring to 155° C. and held for 3 hours. The resulting material (988.3 g) is cooled and bottled.

Comparative Example 16

A succinimide dispersant is prepared by charging a polyisobutenyl succinimide dispersant, derived from 1000 Mn PIBSA and tetraethylene pentamine, (450.4 grams) to a 1 liter reaction flask, equipped similarly to Flask A described above. The material is heated to 150° C. with stirring and held for 1 hour. The material is then cooled to 90° C. Tall oil fatty acid (41.5 grams) is added over 15 minutes. The material is heated, with stirring, at 90° C. and held at this temperature for 1 hour, using these very mild reaction conditions to minimize the amount of amide and cyclic headgroup containing dispersants. The resulting material (486.9 grams) is cooled and collected.

Comparative Example 17

In addition to the examples described above, a commercially available calcium salicylate dispersant with hydrocarbon tails containing about 12 to 16 carbon atoms is used in this testing as a comparative example.

Asphaltene Handling Test Results

In order to confirm the relative performance of these novel asphaltene dispersant, the materials were screened using a blotter strip method. This is performed using the dispersants as a single component. A base oil is prepared by blending 32.6 pbw heavy fuel oil and 67.4 pbw 150N diluent oil. The dispersant to be tested (2 g) is added with 10.15 grams of the base oil blend to a 28 $cm^3$ screw top vial. A Griffin flask shaker is used to mix each sample for 5 minutes and then the sample is placed in an oven at 66° C. for 90 minutes. The vial is then removed from the oven and shaken as above for a further 5 minutes. 15 μl of this mixture is placed on a blotter strip 19 mm from the bottom of the strip (at the spotting line). This is eluted with pentane to a specified level of 153 mm from the spotting line. Each blotter strip is then visually rated according to the amount of material that remains in the original spot and given a rating of 1 to 6 with 1 being the worst and 6 being the best. A summary of the results is provided below.

TABLE 1

Blotter Strip Test Results

| Dispersant Tested[1] | Rating |
|---|---|
| (1-polyisobutenesuccinimidyl)propylimidazole - see Ex 4 | 6 |
| 1-coco-tetrahydro-pyrimidin-2-one - see Ex 5 | 5/6 |
| 2-oleyl-1-(3-dimethylaminopropyl)-1,4,5,6-tetrahydro-pyrimidine - see Ex 1 | 6 |
| 2-oleyl-1-(2-hydroxyethyl)imidazoline - see Ex 2 | 6 |

TABLE 1-continued

| Blotter Strip Test Results | |
|---|---|
| Dispersant Tested[1] | Rating |
| Bis-(1-oleyl-1,4,5,6-tetrahydro-pyrimidin-2-ylmethyl)amine - see Ex 6 | 6 |
| Polyisobutylsuccinmimidyl tall oil amide - see Ex 14 | 6 |
| 2-tallow-1-(polyisobutenylsuccinimidyl)-3,6-diaznoctyl)imidazoline - see Ex 11 | 6 |
| (1-tallow-1,4,5,6-tetrahydropyrimidin-2-yl)methanol - see Ex 3 | 6 |
| 2-oleyl-1-(2-aminoethyl)imidazoline - see Ex 8 | 6 |
| 1-tallow-2-amino-1,4,5,6-tetrahydro-pyrimidine - see Ex 13 | 6 |
| Calcium salicylate dispersant - Comparative Ex 3 | 4 |
| Polyisobutenylsuccinimide - Comparative Ex 15 | 5 |
| Polyisobutenylsuccinimide/tall oil salt - Comparative Ex 16 | 4 |

[1]References to specific examples in the table above indicate that the dispersant in question is prepared by a process substantially similar to that described in the referenced Example.

The results show that the asphaltene dispersants of the present invention provide improved asphaltene handling compared to the commercially available calcium salicylate and corresponding succinimide dispersants. The results also show that the improved performance is present in all of the examples that contain asphaltene dispersants comprising an amide group, whether the example contains a mixture of such dispersants with additional asphaltene dispersants, or was prepared to maximize the content of the amide group-containing compounds.

Additional Test Results

Several compositions were tested to evaluate the performance of the asphaltene dispersants described above. All testing was completed in the two formulations presented below.

TABLE 2

| Formulations of Test Compositions | | |
|---|---|---|
| Component | Formulation A[1] | Formulation B[1] |
| Dispersant | 4.00% wt | 4.00% wt |
| Phenate Detergent | 4.38% wt | |
| Overbased Phenate Detergent | 5.86% wt | 5.86% wt |
| Salicylate Detergent | | 3.60% wt |
| Zinc Alkyldithiophosphates | 0.72% wt | 0.72% wt |
| Antioxidant | 0.30% wt | 0.30% wt |
| Demulsifier | 0.02% wt | 0.02% wt |
| Antifoam Agent | 0.01% wt | 0.01% wt |
| Diluent Oil | 4.71% wt | 5.49% wt |
| Esso 600N Base Oil | 76.00% wt | 76.00% wt |
| Esso 150BS Base Oil | 4.00% wt | 4.00% wt |

[1]All amounts of additives for these formulations are on an oil free basis, with the base oils and a total amount of diluent oil present in the additives listed as a separate component.

Formulation A is a salicylate-free formulation, while Formulation B contains a mixture of salicylate and phenate detergents. All formulations contain 4 percent by weight of the asphaltene dispersant being evaluated, are in the same base oils, and each example has a total base number (TBN) of 40.

Compositions based on Formulations A and B, each using a different dispersant, were tested and compared to compositions using a 1000 number average molecular weight (Mn) polyisobutylene (PIB) derived succinimide dispersant in place of the asphaltene dispersant. The dispersants used in this testing are listed below.

TABLE 3

| Dispersants Tested | | |
|---|---|---|
| Ex No | Dispersant Used[1] | Form |
| A-1 | Amide & Di-cyclic amidine dispersant - see Ex 6 | A |
| A-2 | Cyclic urea dispersant - see Ex 7 | A |
| A-3 | Amide & Diethylenetriamine derived imidazoline - see Ex 8 | A |
| A-4 | Amide & Aminoethyl ethanolamine derived imidazoline - see Ex 9 | A |
| A-5 | Amide & Cyclic amidine dispersant - see Ex 10 | A |
| A-6 | 1000 Mn PIB succinimide derived imidazoline - see Ex 11 | A |
| A-7 | Amide & Glycolic acid amidine dispersant - see Ex 12 | A |
| A-8 | Guanidine amidine dispersant - see Ex 13 | A |
| A-9 | 1000 Mn PIB succinimide dispersant - Comparative Ex | A |
| A-10 | Guanidine amidine dispersant - see Ex 13 | B |
| A-11 | 1000 Mn PIB succinimide dispersant - Comparative Ex | B |

[1]References to specific examples in the table above indicate that the dispersant in question is prepared by a process substantially similar to that described in the referenced Example.

The examples described in the table above were tested in a Pressure Differently Scanning calorimeter (PDSC) test that measures the compositions oxidative induction time (OIT). This is a standard test procedure in the lubricating oil industry, based on CEC L-85 T-99. In this testing the lubricating composition is heated to an elevated temperature, typically about 25° C. below the average decomposition temperature for the sample being tested (in this case 215° C. at 690 kPa), and the time to when the composition begins to decompose is measured. The longer the test time, reported in minutes, the better the oxidative stability of the composition and the additives present within it.

The examples described in the table above were tested in a modified IP 48 test. The test measures the oxidation stability of a lubricant at high temperatures. During the test air is sparged through a test tube containing an amount of lubricant for 24 hours at 200° C. The viscosity of the lubricant is measured before and after completion of the test. The kinematic viscosity of the lubricant at 100° C. (KV100) is measured before the after the test and the ratio of the final KV100/starting KV100 gives an indication of the samples oxidative stability, with ratios closer to 1 showing better performance. The Ramsbottom carbon residue (RCR) is also measured before and after the test, and the ratio of the final/starting RCR also gives an indication of the samples oxidative stability, again with ratios closer to 1 showing better performance.

The examples described in the table above were tested in the one pass MD Hot Tube Test, an in-house test used to evaluate antioxidation performance of a lubricant based on their deposit-forming tendencies by passing a sample of the lubricant dosed with 14% (w/w) heavy fuel oil at 0.25 cc per hour and air at 10 cc per minute through a glass tube for 16 hours at 300° C. The test also assesses the asphaltene handling properties of the test lubricant. The higher the rating, the better the performance of the lubricant.

The results of the testing are presented below.

TABLE 4

| Test Results | | | | |
|---|---|---|---|---|
| Ex No | PDSC OIT (min) | IP48 MOD KV100 Ratio | IP48 MOD RCR Ratio | Hot Tube Rating |
| A-1 | 191 | 1.39 | 1.74 | 71 |
| A-2 | 184 | 1.35 | 1.73 | 84 |
| A-3 | 179 | 1.80 | 2.59 | 0 13 |
| A-4 | 143 | 1.45 | 2.07 | 35 44 |
| A-5 | 186 | 1.48 | 1.92 | 39 |

TABLE 4-continued

| Test Results | | | | |
|---|---|---|---|---|
| Ex No | PDSC OIT (min) | IP48 MOD KV100 Ratio | IP48 MOD RCR Ratio | Hot Tube Rating |
| A-6 | 184 | 1.34 | 1.99 | 75 |
| A-7 | 175 | 1.39 | 1.94 | 57 |
| A-8 | 213 | 1.37 | 1.77 | 87 |
| A-9 | 191 | 1.43 | 2.21 | 81 |
| A-10 | 128 | 1.32 | | 74 76 |
| A-11 | 126 | 1.36 | | 76 |

The results show that the asphaltene dispersants of the present invention can provide improved properties in the lubricating compositions in which they are used, compared to compositions containing commercially available salicylates or other alternative dispersants. These improvements can include improved oxidative stability. The examples in this testing included asphaltene dispersants that contained a mixture of amide group-containing asphaltene dispersants and cyclic headgroup-containing asphaltene dispersants.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." Unless otherwise indicated, all percent values are percents by weight and all ppm values are on a weight basis. Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated. It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

We claim:

1. A lubricating composition comprising:

(a) an oil of lubricating viscosity;

(b) an asphaltene dispersant comprising an amide group; and (c) a detergent derived from an alkyl phenol;

wherein the asphaltene dispersant comprises:

(i) a compound represented by formula (I);

(I)

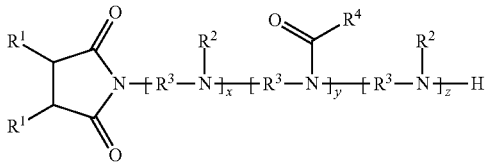

wherein each $R^1$ is independently a hydrogen or a hydrocarbyl group containing 1 to 250 carbon atoms, so long as at least one R1 is a hydrocarbyl group; each $R^2$ is independently a hydrogen or a hydrocarbyl group containing 1 to 10 carbon atoms; each $R^3$ is independently a hydrocarbylene group containing from 1 to 10 carbon atoms; each $R^4$ is independently a hydrocarbyl group containing from 1 to 50 carbon atoms; x is an integer from 0 to 6; y is an integer from 1 to 4; and z is an integer from 0 to 6.

2. The composition of claim 1 wherein the asphaltene dispersant is substantially free of cyclic headgroup that contains a nitrogen atom.

3. The composition of claim 1 wherein the asphaltene dispersant further comprises:

(i) a compound represented by formula (II);

(II)

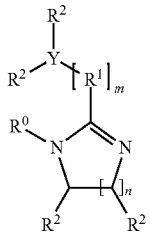

(ii) a compound represented by formula (III);

(III)

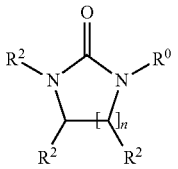

wherein, for formulas (II) and (III) above, each $R^0$ is independently a hydrogen or a hydrocarbyl group containing 1 to 250 carbon atoms; each $R^1$ is independently a hydrocarbyl group comprising 1 to 10 carbon atoms; each $R^2$ is independently hydrogen, a hydroxy group, or a hydrocarbyl group comprising 1 to 50 carbon atoms; Y is a carbon atom or a nitrogen atom; n is 1 or 2; and m is 0 or 1.

4. The composition of claim 1 wherein the asphaltene dispersant further comprises:

(i) a compound represented by formula (IV);

(IV)

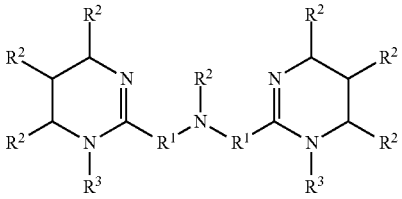

(ii) a compound represented by formula (V);

(V)

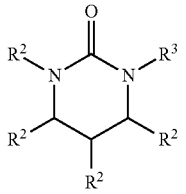

(iii) a compound represented by formula (VI);

(VI)

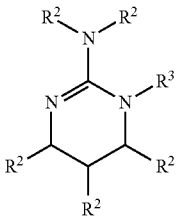

(iv) a compound represented by formula (VII); or (VII)

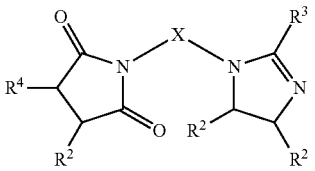

(v) combinations thereof;

wherein, for formulas (IV), (V), (VI) and (VII), each $R^1$ is independently a hydrocarbyl group comprising 1 to 10 carbon atoms; each $R^2$ is independently hydrogen or a hydrocarbyl group comprising 1 to 50 carbon atoms; each $R^3$ is independently a hydrocarbyl group comprising 1 to 50 carbon atoms; $R^4$ is a hydrocarbyl group containing 1 to 200 carbon atoms; and X is a hydrocarbylene group derived from an amine or a polyamine comprising 1 to 20 carbon atoms and 1 to 5 nitrogen atoms.

5. The composition of claim 4 wherein: $R^2$ is monounsaturated; or $R^4$ is derived from polyisobutylene; or X is derived from a polyalkylene polyamine; or combinations thereof.

6. The composition of claim 1 wherein the alkyl phenol detergent is present at 1 percent by weight or more in the overall composition.

7. The composition of claim 1 wherein the alkyl phenol detergent comprises a calcium phenate sulfide.

8. The composition of claim 1 wherein the total base number of the composition is at least 25 wherein at least 50 percent of the base number of the overall composition is delivered by the phenate detergent

9. The composition of claim 1 further comprising (d) a salicylate detergent wherein not more than 50 percent the TBN of the overall composition is delivered from the salicylate detergent.

10. The composition of claim 1 wherein the composition is a marine diesel engine lubricant or a power station combustion engine lubricant.

11. A method of lubricating an internal combustion engine comprising supplying the lubricating composition of claim 1 to an engine.

12. The method of claim 11 wherein the internal combustion engine is a marine diesel engine or a power station combustion engine.

13. The method of claim 12 wherein the marine diesel engine is a 4-stroke trunk piston engine; or wherein the marine diesel engine is a 2-stroke cross-head engine and the lubricating composition is a system oil.

14. A process of preparing an asphaltene dispersant comprising the steps of reacting (i) a substantially linear succinimide dispersant that contains at least two nitrogen atoms where the nitrogen atoms are separated by two or three carbon atoms with (ii) a carboxylic acid, resulting in an asphaltene dispersant comprising an amide group;

wherein the asphaltene dispersant comprises:

(i) a compound represented by formula (I);

(I)

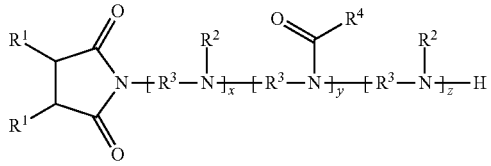

wherein each $R^1$ is independently a hydrogen or a hydrocarbyl group containing 1 to 250 carbon atoms, so long as at least one R1 is a hydrocarbyl group; each $R^2$ is independently a hydrogen or a hydrocarbyl group containing 1 to 10 carbon atoms; each $R^3$ is independently a hydrocarbylene group containing from 1 to 10 carbon atoms; each $R^4$ is independently a hydrocarbyl group containing from 1 to 50 carbon atoms; x is an integer from 0 to 6; y is an integer from 1 to 4; and z is an integer from 0 to 6.

* * * * *